US005290015A

United States Patent [19]

Naritomi et al.

[11] Patent Number: 5,290,015

[45] Date of Patent: Mar. 1, 1994

[54] METHOD OF PRODUCING HIGH-MELTING-POINT AND HIGH-TOUGHNESS METAL AND APPARATUS FOR THE SAME

[75] Inventors: Tatsuo Naritomi, Hyogo; Yoshinobu Toshida, Osaka; Toshiyuki Ohta, Hyogo; Masaji Katsumaru, Osaka; Hisayuki Wada, Hyogo; Takashi Banno, Osaka; Tadayuki Choshi, Kyoto, all of Japan

[73] Assignees: Sumitomo Sitix Co., Ltd., Hyogo; Chugai Ro Co., Ltd., Osaka, both of Japan

[21] Appl. No.: 842,961

[22] Filed: Feb. 28, 1992

[30] Foreign Application Priority Data

Feb. 28, 1991 [JP] Japan ..... 3-47929
Jun. 14, 1991 [JP] Japan ..... 3-140424

[51] Int. Cl.[5] ..... C22B 34/00

[52] U.S. Cl. ..... 266/44; 266/285; 266/905

[58] Field of Search ..... 266/44, 905, 168, 171, 266/174, 78, 91, 285

[56] References Cited

U.S. PATENT DOCUMENTS 3,743,481 7/1973 Nakano ..... 266/905
4,512,557 4/1985 Kimura et al. ..... 266/171
4,565,354 1/1986 Ishizuka ..... 266/905

*Primary Examiner*—Scott Kastler
*Attorney, Agent, or Firm*—Oblon, Spivak, McClelland, Maier & Neustadt

[57] ABSTRACT

A method and apparatus for producing a high-melting-point and high-toughness metal, comprising: reducing a high-melting point and high-toughness metal chloride with an activated metal to form a high-melting-point and high-toughness sponge metal in a reducing vessel arranged sideways relative to a condensing vessel, wherein the condensing vessel is integrally connected to the reducing vessel through a conduit, and at least one of the reducing vessel and/or the condensing vessel is supported so as to move with thermal expansion of said conduit; and measuring a weight-change of the vessel supported so as to move with thermal expansion of the conduit to estimate the degree of progress of a separating and recovering process on the basis of the detected weight-change when nonreacted activated metal and its chloride remaining in the sponge metal formed in the reducing vessel are recovered into the condensing vessel by vacuum separation.

7 Claims, 2 Drawing Sheets

METHOD OF PRODUCING HIGH-MELTING-POINT AND HIGH-TOUGHNESS METAL AND APPARATUS FOR THE SAME

BACKGROUND OF THE INVENTION

Field of the Invention

The present invention relates to an apparatus for producing a high-melting-point and high-toughness metal, such as Ti or Zr, by reductive separation and a method of producing said high-melting-point and high-toughness metal by use of the same.

Discussion of the Background

High-melting-point and high-toughness metals, such as Ti and Zr, have been industrially produced from their chlorides by a reducing method. In the production of a high-melting-point and high-toughness metal by said reducing method, a reducing vessel and a condensing vessel have been used, and recently a construction in which both vessels are arranged side by side and connected to each other through a horizontal conduit has been adopted in many cases.

With such an apparatus, a high-melting-point and high-toughness sponge metal is formed in the reducing vessel and then unreacted activated metal and its chlorides remaining in said sponge metal are separated in a vacuum and recovered in the condensing vessel through said conduit. When the substances separated in a vacuum are recovered in the condensing vessel, they must be prevented from coagulating within the conduit. Conventionally the conduit is heated, but thermal expansion of the conduit upon heating is unavoidable. The elongation of the conduit resulting from thermal expansion amounts to several centimeters or more in a large-sized apparatus and, thus, it has been called in serious question in an apparatus in which the reducing vessel is connected with the condensing vessel through the horizontal conduit. Accordingly, it has been an important theme in redesign of apparatuses of this type to absorb the thermal expansion of the conduit. A connecting structure in which a conduit is cut apart midway thereof, to form a gap there, has been disclosed as a useful method of dealing with the problem in Japanese Patent Application Laid-Open No. Sho 59-80593.

However, with the above-described connecting structure, the thermal expansion of the conduit in a small-sized apparatus can be readily absorbed by the above described gap, but elongation of the conduit amounting to several centimeters or more in a large-sized apparatus cannot be readily absorbed. Accordingly, stresses are concentrated at portions where the conduits are connected to each other and where the conduits are connected to the vessels, and thus these connecting portions often crack. Moreover, it has been required that a packing for sealing the above-described gap be provided with cooling means. This cooling is carried out together with the heating of the conduit, so that it is technically difficult and the connecting structure is complicated. It cannot be said that this method is truly practical.

In addition, when the unreacted activated metal and chlorides remaining in the high-melting-point and high-toughness sponge metal formed in the reducing vessel are recovered in the condensing vessel, if the quantity of substances remaining in the reducing vessel are increased, the quality of the products deteriorate while if the separating treatment in a vacuum is carried out beyond what is necessary, consumption of electric power is increased, spoiling the economy. Accordingly, it is required to accurately control the final quantity of substances remaining in the reducing vessel. However, there has been no quantitative method for detecting the substances remaining in the reducing vessel. Thus, the time required for the separating and recovering process has been statistically determined on the basis of a change in electric power consumption and an empirical calculation of time. As a result, a problem has occurred in that the quantity of substances remaining in the reducing vessel is not constant.

SUMMARY OF THE INVENTION

An object of the present invention is to provide an apparatus for producing a high-melting-point and high-toughness metal capable of perfectly absorbing the thermal expansion of a conduit using a simplified construction.

Another object of the present invention is to provide a method of producing a high-melting-point and high-toughness metal wherein it is possible to quantitatively estimate the degree of progress of separating and recovering processes, and achieve said separating and recovering processes within a reasonable time when substances that remain in the reducing vessel are separated and recovered; and an apparatus for the same.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

Figure 1:
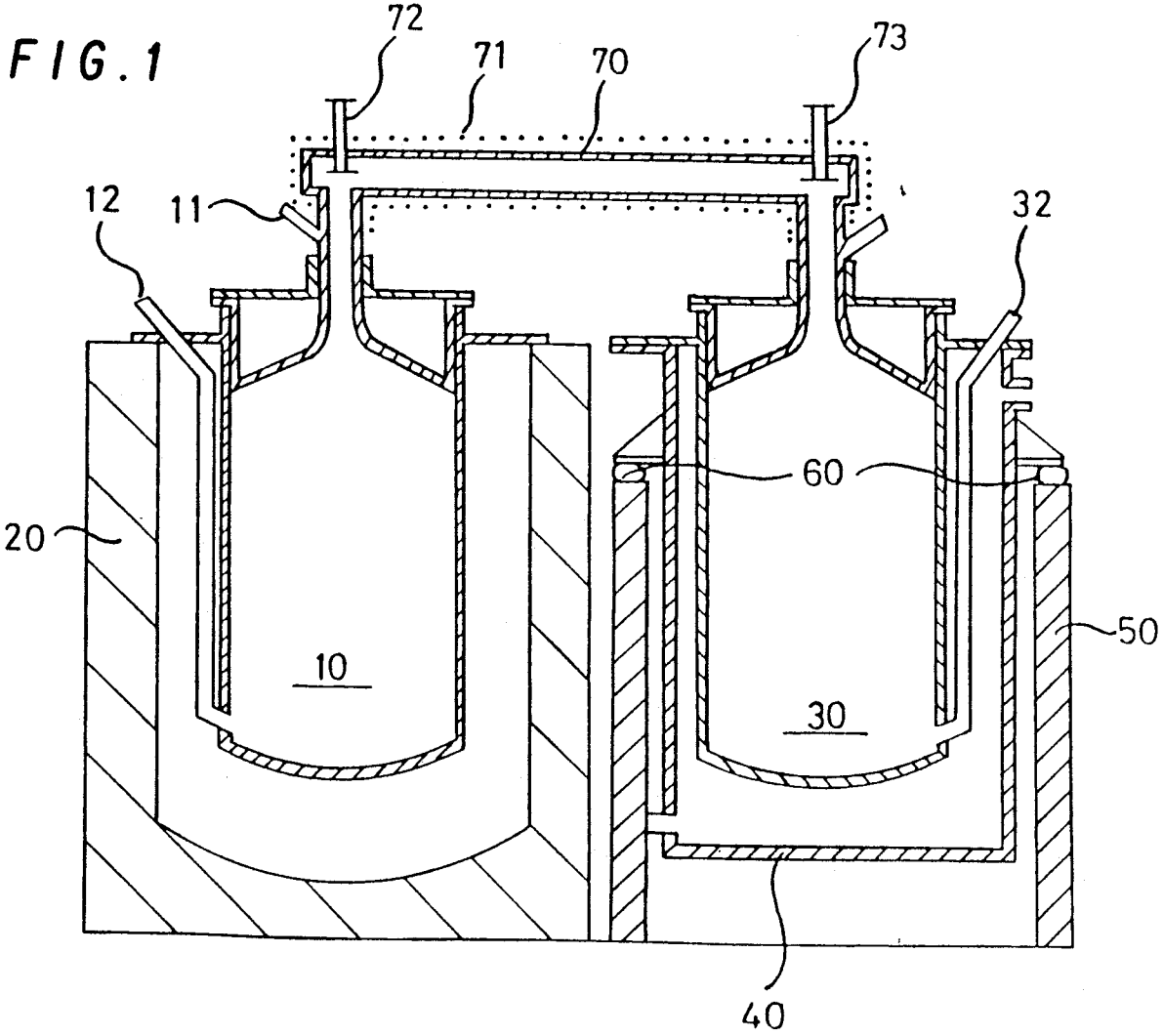
FIG. 1 is a sectional view showing an apparatus according to one preferred embodiment of the present invention.

10: Reducing vessel; 16: Weight sensor; 20: Heating furnace; 30: Condensing vessel; 40: Cooling jacket; 50: Trestle; 60: Air spring; 70: Conduit.

DETAILED DESCRIPTION OF THE PREFERRED EMBODIMENTS

An apparatus according to the present invention comprises a reducing vessel for reducing chlorides of a high-melting-point and high-toughness metal to be produced with an activated metal to form a high-melting-point and high-toughness sponge metal, and a condensing vessel for recovering the nonreacted activated metal and its chlorides remaining in said sponge metal formed in said reducing vessel by a vacuum separation. It is characterized in that said condensing vessel is arranged sideways relatively to the reducing vessel, the condensing vessel being integrally connected with the reducing vessel through a conduit, and at least one of the reducing vessel and/or the condensing vessel being supported so as to move with the thermal expansion of said conduit.

In said apparatus according to the present invention, at least one of the reducing vessel and/or the condensing vessel moves with the thermal expansion of the conduit on the whole, so that, even though both vessels are integrally connected with each other through the conduit, the thermal expansion of the conduit can be precisely absorbed. Accordingly, the whole conduit can be integrally constructed, the conduit being easily heated while packings and a cooling mechanism therefor become unnecessary. Thus, the conduit and incidental mechanisms thereof are remarkably simplified.

In addition, the amount of thermal expansion of a conduit is influenced by the quantity and temperature of substances recovered through the conduit, and thus predicting the amount of elongation of the conduit is complicated. However, in the present invention thermal expansion is absorbed by moving the vessel as thermal expansion occurs, therefor the vessel can accurately follow any degree of complicated elongation of the conduit and thus the elongation of the conduit can be surely absorbed.

In the apparatus according to the present invention, at least one of the reducing vessel and/or the condensing vessel is movable, but it is desirable with respect to actual operation that merely the condensing vessel be movable. Because, for example, the weight of contents in the condensing vessel is generally less than that in the reducing vessel during the separating and recovering process, and thus the condensing vessel is more easily moved. There is also the possibility that the heated condition of the reducing vessel might change if the reducing vessel is moved. However, in principle, either vessel can be moved to compensate the conduit expansion.

As to practical means of making the vessels movable, it is desirable to directly or indirectly support them by means of a fluid spring. In the case where the vessels are supported by means of a fluid spring, the vessels can be moved by a slight outside force and thus stress applied to the conduit can be minimized. Additionally, the vessels can be simply held at an appointed height by regulating a fluid pressure even though the weight of the vessels changes with progress of the recovering process.

Furthermore, if said fluid pressure is measured while the vessels are held at said appointed height by regulating a liquid pressure, the quantity of substances in the vessels can be quantitatively detected. Thus, the degree of progress of the separating and recovering processes can be accurately estimated.

In the case where one of the reducing vessel and/or the condensing vessel is made movable, the other may be supported through a weight sensor so as to detect the weight of the vessel. Also in this case, the degree of progress of the separating and recovering process can be quantitatively estimated. That is to say, if a change of the reducing vessel in weight is measured, the quantity of substances remaining in the reducing vessel can be determined, and, if a change in weight of the condensing vessel is measured, the quantity of the remaining substances recovered in the condensing vessel can be determined.

The weight sensor can include mechanical means directly weighing a change in weight of the vessels and the like, in addition to electric means such as with a load cell or a strain gauge. In addition, it is also possible to detect the weight of the vessel movably supported by means of these weight sensors.

A method according to the present invention consists of quantitatively estimating the degree of progress of the separating and recovering process by utilizing the movability of at least one of the reducing vessel and/or the condensing vessel in the above-described apparatus to detect a change in weight of the movable vessel. Thus, the time required for the recovering treatment can be accurately set.

Furthermore, one of the reducing vessel and the condensing vessel is supported so as to move with the thermal expansion of the conduit, and the other is supported through the weight sensor to detect the change in weight of the fixed vessel supported through the weight sensor by means of the weight sensor, whereby estimating the degree of progress of the separating and recovering process.

Having generally described this invention, a further understanding can be obtained by reference to certain specific examples which are provided herein for purposes of illustration only and are not intended to be limiting unless otherwise specified.

EXAMPLE 1

A preferred embodiment of the present invention will be described in detail for production of Ti.

FIG. 1 is a sectional view showing one example of an apparatus to which the present invention is applied.

A reducing vessel 10 is housed in a heating furnace 20. Said reducing vessel 10 is provided with an introducing pipe 11 of $TiCl_4$ connected therewith in a mouth portion in an upper part thereof and a discharging pipe 12 of byproducts connected therewith in a bottom portion thereof.

A condensing vessel 30 is housed in a cooling jacket 40 and has the same construction as the reducing vessel 10 to be replaceable with the reducing vessel 10. Said cooling furnace 40 is supported on a cylindrical trestle 50 arranged side by side with said heating furnace 20 under a floating condition through an air spring 60 and provided with a level-meter. Said air spring 60 is formed of a circular air bag connected with an air-supplying device (not shown). Said air-supplying device regulates air pressure applied to the air spring 60 on the basis of an output from said level-meter to hold the height of the cooling furnace 40 constant.

Said mouth portion in said upper part of the reducing vessel 10 is connected with a mouth portion in an upper part of said condensing vessel 30 through a horizontal conduit 70. Said conduit 70 is detachably combined with said both mouth portions and an outer circumferential surface thereof is covered with a heater 71. Valves 72, 73 are disposed between the conduit 70 and both mouth portions.

In production of Ti in such an apparatus, the reducing vessel 10 is set in the heating furnace 20 and the condensing vessel 30 is set in the cooling furnace 40 to support the cooling furnace 40 on said vessel 50 by means of the air spring 60. At this time, the condensing vessel 30 and the cooling jacket 40 are set so that the conduit 70 may be positioned at a neutral point of the air spring 60 under the thermally expanded condition. And, the condensing vessel 30 and the cooling jacket 40 are drawn closer to the reducing vessel 10 by a distance corresponding to the expansion of the conduit 70 to connect the reducing vessel 10 with the condensing vessel 30 through the conduit 70.

Then, the heating furnace 20 is operated under the condition that said valves 72, 73 are closed to hold molten Mg within the reducing vessel 10 and $TiCl_4$ is introduced into molten Mg through said introducing pipe 11, whereby Ti and $MgCl_2$ are formed within the reducing vessel 10. The formed $MgCl_2$ is suitably discharged outside through said discharging pipe 12. And, finally, sponge Ti containing unreacted Mg and $MgCl_2$ is obtained.

After completion of the reducing process, the valves 72, 73 are opened followed by heating the heating furnace 20 to temperatures of 1,000° C. or more and heating the conduit 70 to temperatures at which Mg and $MgCl_2$ are not condensed, by means of said heater 71. In addition, the condensing vessel 30 is evacuated utilizing a discharging pipe 32 with cooling within the cooling jacket 40. Thus, nonreacted Mg and $MgCl_2$ contained in said sponge Ti within the reducing vessel 10 are evaporated to be collected in the condensing vessel 30 through the conduit 70.

In this separating and recovering process, the conduit 70 is expanded and elongated in the axial direction due to heating by means of the heater 71. However, the condensing vessel 30 moves in relation to the reducing vessel 10 together with the cooling furnace 40. Elongation of the conduit 70 compensates for the distance which the condensing vessel 30 moved, when the condensing vessel 30 has previously drawn closer to the heating furnace 20, whereby returning the condensing vessel 30 and the cooling furnace 40 to said neutral point of the air spring 60. Accordingly, no significant stress is produced in the conduit 70 or the portions where conduit 70 is connected to the vessels.

Besides, as Mg and $MgCl_2$ are collected within the condensing vessel 30, the weight of the condensing vessel 30 is increased and thus the load applied to the air spring 60 is increased, but the air pressure of the air spring 60 is increased so that the height of the condensing vessel 30 may be held constant; so that the reducing vessel 10 and the condensing vessel 30 can be always held at the same level. Accordingly, stress resulting from an inclination of the conduit 70 can also be prevented from being produced.

According to the present method, the air pressure of the air spring 60 is detected during the separating and recovering process in the production of Ti. This air pressure is, as mentioned above, increased with an increase in weight of the condensing vessel 30, so that the weight of the condensing vessel 30 can be quantitatively detected by detecting the air pressure. Thus, the quantity of Mg and $MgCl_2$ collected within the condensing vessel 30 can be accurately measured. In short, the quantity of Mg and $MgCl_2$ evaporated and recovered can be quantitatively detected by measuring the air pressure applied to the air spring 60. And, changes in the quantity of nonreacted Mg and the quantity of $MgCl_2$ contained in sponge Ti within the reducing vessel 10 are made clear from the changes in quantities of Mg and $MgCl_2$ evaporated and recovered, the change in electricity consumed which has been conventionally utilized, and the like. Thus the optimum time required for the separating and recovering treatment can be determined. As a result, the quantities of Mg and $MgCl_2$ remaining in sponge Ti can be sufficiently reduced and thus wasteful treating time can be reduced to economize in electric power consumed.

Table 1 shows the quantity of electric power consumed and the quantity of substances remaining in sponge Ti in the conventional method and the present invention, respectively. Provided that the quantity of electric power consumed in the conventional method is 100, the quantity of electric power consumed in the method according to the present invention is reduced to 90 and also the fluctuation of the quantity of chlorine in sponge Ti is remarkably reduced in the method according to the present invention.

TABLE 1

| | Conventional method | Method according to the present invention |
|---|---|---|
| Quantity of electric power consumed | 100 | 90 |
| Deviation in the case where the content of chlorine is constant | 800 ppm<br>$\delta = 200$ | 800 ppm<br>$\delta = 100$ |

EXAMPLE 2

Figure 2:
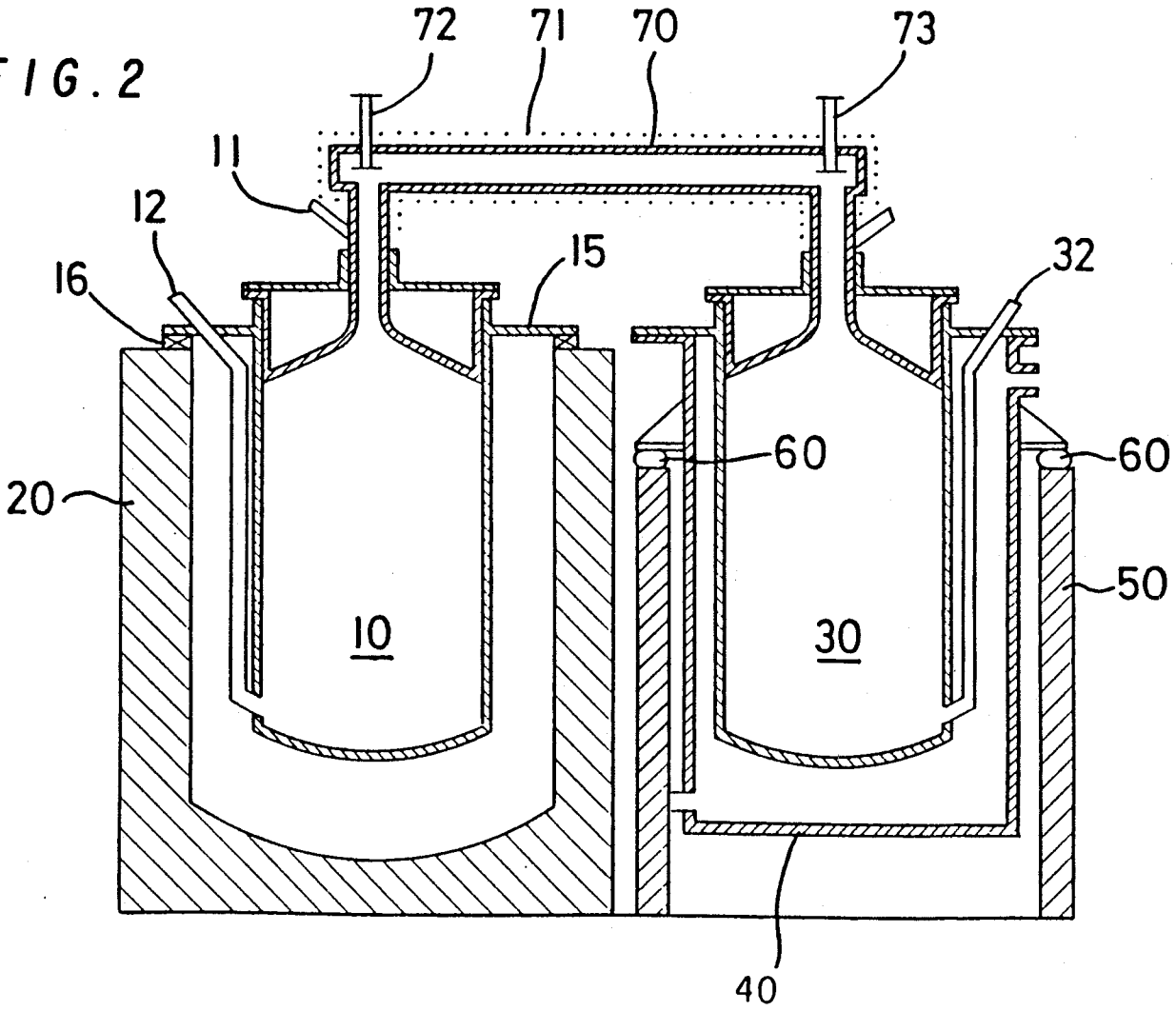
FIG. 2 is a sectional view showing an apparatus according to another preferred embodiment of the present invention.

A load cell as the weight sensor is disposed between a lower surface of a flange portion 15 supporting a reducing vessel 10 within a heating furnace 20 and an upper surface of said heating furnace 20, as shown in FIG. 2. The rest is the same as in Example 1.

A reducing process is completed by the same operation as in Example 1 and a separating and recovering process is carried out. In said separating and recovering process, a change in weight of said reducing vessel 10 is measured by means of said load cell 16. Said weight of the reducing vessel 10 is reduced depending upon the quantities of Mg and $MgCl_2$ scattered and lost from sponge Ti within the reducing vessel 10. Accordingly, a quantity of Mg and $MgCl_2$ evaporated and recovered is quantitatively detected by measuring said change of the reducing vessel 10 in weight. Changes in the quantity of nonreacted Mg and the quantity of $MgCl_2$ contained in sponge Ti within the reducing vessel 10 are made clear from the change in quantity of Mg and $MgCl_2$ evaporated and recovered, the change in electricity consumed which has been conventionally utilized, and the like. Thus the optimum time required for the separating and recovering treatment can be determined. As a result, the quantities of Mg and $MgCl_2$ remaining in sponge Ti can be sufficiently reduced and thus a wasteful treating time can be reduced to economize in electric power consumed.

According to the present method of producing high-melting-point and high-toughness metals and apparatus for the same, the thermal expansion of the conduit called in question in the case where the reducing vessel and the condensing vessel are integrally arranged side-by-side can be reproducibly absorbed, thereby preventing the conduit itself, and the portions where the conduit is connected to the vessels, from being cracked and damaged, thus prolonging the useful life time of the apparatus. In addition, since the conduit can be integrated as a whole, it is unnecessary to use a packing or similar device midway on the conduit. Therefore, the conduit can be simplified in construction, it can be easily heated, and both the conduit and its connecting portions are prevented from being choked. Furthermore, the time required for separating and recovering the remaining substances can be optimized and thus the reduction of electric power consumed and the improvement of the products in quality can be achieved.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for producing a high-melting-point and high-toughness metal comprising a reducing vessel for reducing chlorides of said high-melting-point and high-toughness metal to be produced with an activated metal to form a high-melting-point and high-toughness sponge metal and a condensing vessel for recovering a nonreacted activated metal and its chlorides remaining in said sponge metal formed in said reducing vessel by a vacuum separation, wherein said condensing vessel is arranged sideways relative to the reducing vessel, the condensing vessel being contained in a cooling jacket and integrally connected with the reducing vessel through a conduit, and at least one of the reducing vessel and/or the condensing vessel being supported so as to move with thermal expansion of said conduit.

2. An apparatus for producing a high-melting-point and high toughness metal as set forth in claim 1, wherein means for detecting the weight of said vessel supported so as to move with said thermal expansion of the conduit are provided.

3. An apparatus for producing a high-melting-point and high toughness metal as set forth in claim 1, wherein the reducing vessel and/or the condensing vessel is supported so as to move with the thermal expansion of the conduit and the other is supported through a weight sensor.

4. An apparatus for producing a high-melting-point and high-toughness metal as set forth in any one of claims 1 to 3, wherein the vessel, which is supported so as to move with the thermal expansion of the conduit, is the condensing vessel.

5. An apparatus for producing a high-melting-point and high-toughness metal as set forth in any one of claims 1 to 3, characterized in that said means for supporting the vessel so as to move with the thermal expansion of the conduit is a fluid spring.

6. A method of producing a high-melting-point and high-toughness metal, comprising: reducing a high-melting-point and high-toughness metal chloride with an activated metal to form a high-melting-point and high-toughness sponge metal in a reducing vessel arranged sideways relative to a condensing vessel, wherein the condensing vessel is contained in a cooling jacket and integrally connected to the reducing vessel through a conduit at least one of the reducing vessel and/or the condensing vessel is supported so as to move with thermal expansion of said conduit; and measuring a weight-change of the vessel supported so as to move with thermal expansion of the conduit to estimate the degree of progress of a separating and recovering process on the basis of the detected weight-change, when nonreacted activated metal and its chloride remaining in the sponge metal formed in the reducing vessel are recovered into the condensing vessel by vacuum separation.

7. A method of producing a high-melting-point and high-toughness metal, comprising: reducing a high-melting-point and high toughness metal chloride with an activated metal to form a high-melting-point and high-toughness sponge metal in a reducing vessel arranged sideways relative to a condensing vessel, wherein the condensing vessel is integrally connected to the reducing vessel through a conduit, and at least one of the reducing vessel and the condensing vessel is supported so as to move with thermal expansion of said conduit, the other being supported through a weight sensor; and measuring a weight-change of the vessel supported through said weight sensor by means of the weight sensor to estimate the degree of progress of a separating and recovering process on the basis of the detected weight-change when nonreacted activated metal and its chloride remaining in the sponge metal formed in the reducing vessel are recovered into the condensing vessel by vacuum separation.

* * * * *

UNITED STATES PATENT AND TRADEMARK OFFICE

CERTIFICATE OF CORRECTION

PATENT NO. : 5,290,015

DATED : March 1, 1994

INVENTOR(S) : Tatsuo NARITOMI, et al.

It is certified that error appears in the above-indentified patent and that said Letters Patent is hereby corrected as shown below:

On the title page, Item [30], the Foreign Application Priority Data should be deleted.

Signed and Sealed this

Fifth Day of July, 1994

*Attest:*

Bruce Lehman

BRUCE LEHMAN

*Attesting Officer*

*Commissioner of Patents and Trademarks*